US005286706A

United States Patent [19]

Mochizuki et al.

[11] Patent Number: 5,286,706

[45] Date of Patent: Feb. 15, 1994

[54] SUBLIMATION-TYPE THERMAL IMAGE TRANSFER RECORDING MEDIUM

[75] Inventors: Hidehiro Mochizuki, Numazu; Masaru Shimada, Shizuoka; Naoya Morohoshi, Numazu; Hiroyuki Uemura, Numazu; Chiharu Nogawa, Numazu; Yutaka Ariga, Fuji, all of Japan

[73] Assignee: Ricoh Company, Ltd., Tokyo, Japan

[21] Appl. No.: 696,716

[22] Filed: May 7, 1991

[30] Foreign Application Priority Data

May 8, 1990 [JP] Japan ..... 2-116878
May 10, 1990 [JP] Japan ..... 2-118661
Jan. 28, 1991 [JP] Japan ..... 3-25115

[51] Int. Cl.[5] ..... B41M 5/035; B41M 5/38

[52] U.S. Cl. ..... 503/227; 428/195; 428/423.1; 428/913; 428/914

[58] Field of Search ..... 8/471; 428/195, 013, 428/914, 423.1; 503/227

*Primary Examiner*—B. Hamilton Hess
*Attorney, Agent, or Firm*—Oblon, Spivak, McClelland, Maier & Neustadt

[57] ABSTRACT

A sublimation-type thermal image transfer recording medium is composed of a support and a plurality of ink layers, such as yellow, magenta and cyan ink layers, and a black ink layer if necessary, formed on the support side by side, or on different separate supports, each ink layer containing an organic binder agent and a sublimable dye dispersed in the organic binder agent, with the gram-absorptivity coefficient of the sublimable dye being 150,000 or more.

14 Claims, 6 Drawing Sheets

SUBLIMATION-TYPE THERMAL IMAGE TRANSFER RECORDING MEDIUM

BACKGROUND OF THE INVENTION

1. Field of the Invention

The present invention relates to a sublimation-type thermal image transfer recording medium, and more particularly to a sublimation-type thermal image transfer recording medium capable of forming images with high image density on a transparent image-receiving film such as an OHP film for use with an overhead projector, and capable of performing multiply printing operations.

2. Discussion of Background

The optical path for forming a transmission-type image, such as an image made through a transparent film used for an over head projector (OHP) is a half the optical path for forming a reflection-type image. Therefore, even if such a transmission-type image is formed by use of a conventional image transfer recording medium for forming the reflection-type image, the obtained image density is insufficient for use in practice.

Under such circumstances, various types of image transfer recording media capable of forming a transmission-type image with high density have been proposed, for example, by the following improvements:

(1) The total amount of a dye contained in an ink layer of an image transfer recording medium is increased. In this kind of recording medium, as a matter of course, the thickness of the ink layer increases, which results in a decrease in the thermal sensitivity.

(2) The concentration of a dye in an ink layer of an image transfer recording medium is increased. In this kind of recording medium, although the thickness of the ink layer does not substantially increase, the amount of a binder agent contained in the ink layer is relatively decreased. As a result, the mechanical strength of the ink layer is decreased and the adhesion between the ink layer and a support is reduced. The ink layer is therefore readily peeled off the support and is inappropriately transferred to an image-receiving medium. In addition to the above, crystallization of the dye contained in the ink layer is induced and bleeding of the dye to the surface of the ink layer takes place. These have serious adverse effects on the preservability of the obtained images.

(3) A low-softening point material is added to an ink layer of an image transfer recording medium. In this kind of recording medium, due to the addition of a low-softening point material to the ink layer, the mechanical strength of the ink layer is decreased in particular during the printing operation. Consequently, the ink layer is entirely or partially peeled off the support or inappropriately transferred to the image-receiving medium in the course of printing operation. Furthermore, the preservability of the ink layer itself is reduced.

A thermal image transfer recording media for use in multiple printing has also been proposed, but has the drawbacks as mentioned in the above proposals (1) and (2).

SUMMARY OF THE INVENTION

Accordingly, an object of the present invention is to provide a thermal image transfer recording medium, free from the shortcomings of the deterioration in thermosensitivity, the exfoliation of an ink layer from a support, and the decrease in preservability of the ink layer, capable of forming a transmission-type image with high image density.

Another object of the present invention is to provide a thermal image transfer recording medium which can repeatedly yield images with high image density on an image-receiving medium by the multiple printing method.

The above-mentioned objects of the present invention can be achieved by a sublimation-type thermal image transfer recording medium comprising (i) a support and (ii) a plurality of ink layers with different colors such as yellow, magenta and cyan, and black if necessary, formed on the above support side by side, each ink layer comprising an organic binder agent and a sublimable dye dispersed in the organic binder agent, with the gram-absorptivity coefficient of each sublimable dye being 150,000 or more.

The above objects of the present invention can also be achieved by a sublimation-type thermal image transfer recording medium comprising a plurality of sublimation-type thermal image transfer recording sheets for the respective colors of yellow, magenta and cyan, and black if necessary, each recording sheet comprising a support and an ink layer of one of the respective colors formed on the above support, which comprises an organic binder agent and a sublimable dye dispersed in the above organic binder agent, with the gram-absorptivity coefficient of the sublimable dye being 150,000 or more.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
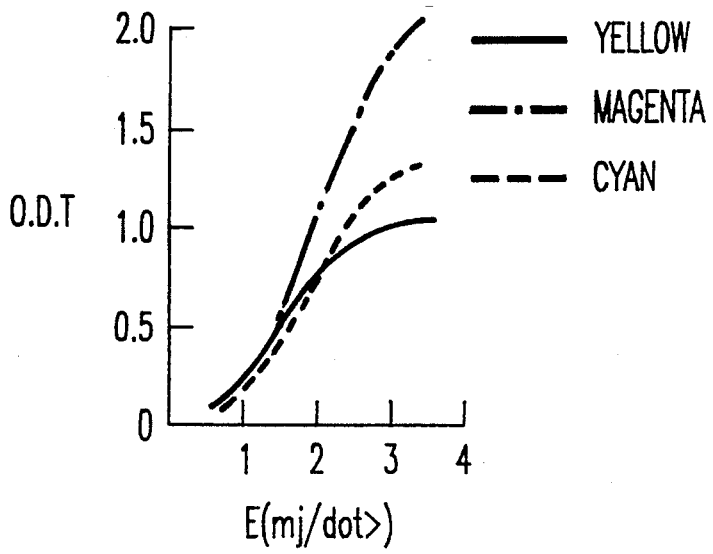
FIGS. 1 to 3 are graphs showing the relationship between the printed image density and the thermal energy applied to thermal image transfer recording media according to the present invention, which are respectively obtained in Examples I-1 to I-3.

In an ink layer of the thermal image transfer recording medium of the present invention, a sublimable dye with a gram-absorptivity coefficient of 150,000 or more is dispersed in an organic binder agent.

The gram-absorptivity coefficient ($\alpha$) of the sublimable dye can be obtained by the following formula:

$$T=100\text{-}\exp(-\alpha\cdot C)$$

wherein T(%) is the transmission of a solution of a sublimable dye employed; $\alpha$ is the gram-absorptivity coefficient of the dye; and C(g/ml) is the concentration of the dye in the above solution As previously mentioned, the amount of a sublimable dye that can be contained in the ink layer of the sublimation-type thermal image transfer recording medium is limited when the thickness of the ink layer or the thermosensitivity of the ink layer is taken into consideration. When the sublimable dye having a gram-absorptivity coefficient of 150,000 or more is used, high optical density (0.D.) of obtained transmission-type images can be obtained even if a limited amount of the dye is employed.

The thermal image transfer recording medium of the present invention comprises yellow, magenta, cyan, and when necessary, black ink layers, which may be arranged side by side in a row on the support. Alternatively, the thermal image transfer recording medium of the present invention may be composed of a plurality of sublimation-type thermal image transfer recording sheets of the above colors, each sheet comprising a support and an ink layer of the respective color, formed thereon A multicolor image is formed on an image-receiving medium by overlapping the yellow, magenta and cyan colors of the respective ink layers.

Each ink layer of the three (or four) colors is required to be capable of producing an image with an identical optical density It is, therefore, necessary that each ink layer comprise the sublimable dye having a gram-absorptivity coefficient of 150,000 or more.

The black color for the black ink layer is producing by mixing yellow, magenta and cyan dyes. To impart the desired gram-absorptivity coefficient to the thus prepared black dye, yellow, magenta and cyan dyes are adjusted in such a mixing ratio at which the gram-absorptivity coefficient of the mixed black dye falls within the above-mentioned range.

As the sublimable dyes for use in the ink layer of the recording medium of the present invention, any of disperse and oil-soluble dyes which are ordinarily used in the field of thermal image transfer recording can be employed, if it has a gram-absorptivity coefficient of 150,000 or more, and can sublime or vaporize at a temperature of 60° C. or more.

Examples of the commercially available yellow dyes for use in the present invention are "PSD-290(Y)", "PSD-3(Y)", "Yellow 1011" and "Yellow 1012" (Trademarks), made by Sumitomo Chemical Co., Ltd.; "Foron Brilliant Yellow S-6GL"(Trademark), made by Sandoz K.K.; "Yellow RP" and "Yellow VP" (Trademarks), made by Mitsui Toatsu Dyes Ltd ; "KST Yellow 963" and "KST AG" (Trademarks), made by Nippon Kayaku Co., Ltd.; "Macrolex Yellow 6G" (Trademark), made by Bayer A.G.; and "Plst Yellow 8040" (Trademark), made by Arimoto Chemical Co., Ltd.

Examples of the commercially available magenta dyes for use in the present invention are "HM1041" (Trademark), made by Mitsui Toatsu Dyes Ltd.; and "Sudan Red 380" (Trademark), made by BASF Japan Ltd.

Examples of the commercially available cyan dyes for use in the present invention are "Mitsui Blue HM-1034"(Trademark), made by Mitsui Toatsu Chemicals, Inc.; "KST Blue K-FL" (Trademark), made by Nippon Kayaku Co., Ltd.; "Foron Brilliant Blue SR" (Trademark), made by Sandoz K.K.; and "HSO-144" (Trademark), made by Mitsui Toatsu Dyes Ltd.

These sublimable yellow, magenta and cyan dyes may be used alone in the respective ink layers. Alternatively, they can separately be mixed with other dyes having a gram-absorptivity of less than 150,000, which can sublime or vaporize at a temperature of 60° C. or more.

The above sublimable dye is dispersed in the binder agent in the ink layer Particularly for the purpose of producing a transmission-type image, the following binder agents are preferably employed in the thermal image transfer recording medium of the present invention: a vinyl chloride resin, a vinyl acetate resin, polyamide, polyethylene, polycarbonate, polystyrene, polypropylene, an acrylic resin, a phenolic resin, polyester, polyurethane, an epoxy resin, a silicone resin, a fluorine-containing resin, a butyral resin, a melamine resin, a natural rubber, a synthetic rubber, polyvinyl alcohol and a cellulose resin. These can be used alone or in combination, and in addition, copolymers thereof can be employed in the present invention.

In the case of the thermal image transfer recording medium for producing a transmission-type image, it is preferable that the dye concentration in the ink layer be in the range of about 5 to 80 wt.%, and more preferably in the range of about 10 to 60 wt.%. The thickness of this type of ink layer is preferably 0.1 to 30 $\mu$m, and more preferably in the range of 0.5 to 2.0 $\mu$m.

The thermal image transfer recording medium of the present invention can also be employed in an n-times-printing mode which is a multiple printing method. In the n-times-printing mode, the running speed of the image receiving medium is made n ($n>1$) times the running speed of the thermal image transfer recording medium while images are printed, and the ink layer is shifted in such a manner that the first used portion and the second used portion are overlapped each other.

In the case where the thermal image transfer recording medium is used in the n-times-printing mode, a cured resin is preferably used as a binder agent in the ink layer More preferably, an urethane compound formed by reacting a compound having an active hydrogen to allow with an isocyanate compound is employed as a binder agent.

Specific examples of such a compound having an active hydrogen are polyvinyl butyral, polyvinyl acetal, polyurethane polyol, polyether polyol, polyester polyol, polyacrylate, an acryl—polyester copolymer, an alkyd resin, silicone polyester, an epoxy resin having an epoxy group opened by an alkanol amine Of these, polyvinyl butyral is preferred when the compatibility with the dye, the barrier property of preventing the diffusion of dye particles, and the preservability of the ink layer are taken into consideration.

For the isocyanate, diisocyanate and tolylenediisocyanate are effective. For example, 2,4-tolylenediisocyanate, 2,6-tolylenediisocyanate, 4,4'-diphenylmethane diisocyanate, hexamethylene diisocyanate, xylylene diisocyanate, triphenylmethane triisocyanate, isophorone diisocyanate, bisisocyanate methylcyclohexane and trimethyl-hexamethylene diisocyanate are preferable.

From the handling point of view, commercially available isocyanates "Coronate L" (Trademark), made by Nippon Polyurethane Industry Co., Ltd.; and "Takenate D"(Trademark), made by Takeda Chemical Industries, Ltd., are preferably employed.

It is preferable to blend the isocyanate compound and the compound having an active hydrogen in such an amount that the ratio of —NCO groups contained in the isocyanate compound to —OH groups contained in the compound having an active hydrogen is in the range of from 0.1 : 1 to 1 : 1.

In the case of the thermal image transfer recording medium employing the n-time-speed mode method as a multiple printing method, it is preferable that the dye concentration in the ink layer be in the range of about 5 to 80 wt.%, and more preferably in the range of about 10 to 60 wt.%.

The thickness of such an ink layer is preferably 0.1 to 30 μm, and more preferably in the range of 1.0 to 20 μm.

When the thermal image transfer recording medium employing the n-time-speed mode method as the multiple recording method is prepared, a lubricant or releasant is preferably contained in the ink layer.

Examples of the lubricant or releasant for use in the present invention include petroleum lubricant oils such as liquid paraffin; synthetic lubricant oils such as halogenated hydrogen, diester oil, silicone oil and fluorine-containing oil; silicone-containing lubricants such as modified silicone oils, for example, an epoxy-modified silicone oil, an amino-modified silicone oil, an alkyl-modified silicone oil and a polyester-modified silicone oil, and a copolymer of an organic compound, for example, polyoxyalkylene glycol and silicone; fluorine-containing lubricants such as a fluorine-containing surface active agent, for example, a fluoroalkyl compound, and trifluorinated ethylene chloride polymer having a low molecular weight; waxes such as paraffin wax and polyethylene wax; higher fatty acids; higher fatty alcohols; higher fatty amides; higher fatty esters; and salts of higher fatty acids.

The amount of the lubricant or releasant incorporated into the ink layer is preferably 5 to 30 wt.% of the total weight of the ink layer. As far as the amount of the lubricant or releasant falls within the above range, fusing between the ink layer and the image-receiving medium can be prevented, and the ink layer can have high preservability.

Examples of the material for the support of the thermal image transfer recording medium of the present invention include a sheet of condenser paper, a polyester film, a polystyrene film, a polysulfone film, a polyimide film and a polyamide film.

An adhesive layer may be interposed between the support and the ink layer if necessary. In addition, a heat-resistant releasing layer may be formed on a surface of the support opposite to the ink layer, if necessary. The adhesive layer and the heat-resistant releasing layer conventionally used in the thermal image transfer recording medium can be used in the present invention.

Furthermore, the ink layer of the thermal image transfer recording medium of the present invention may be of a function-separated type as disclosed in Japanese Laid-Open Patent Application 1-586. Namely, the ink layer consists of a dye-transfer layer, from which a dye is actually transferred to the image-receiving medium, and a dye-supply layer which serves to replenish the above dye-transfer layer with the dye.

As disclosed in Japanese Laid-Open Patent Application 1-157891, the thermal image transfer recording medium comprising a single-type ink layer in which a dye in the form of finely-divided particles is dispersed is one of the preferred embodiments when the thermal image transfer is conducted by the multiple printing method such as the n-times-printing mode and ordinary multiple printing modes.

Other features of this invention will become apparent in the course of the following description of exemplary embodiments, which are given for illustration of the invention and are not intended to be limiting thereof.

EXAMPLE I-1

Preparation of Yellow Ink Composition

The following components were placed in a ball mill and dispersed for 24 hours to obtain a yellow ink composition.

| | Parts by Weight |
|---|---|
| Organic binder agent: Polyvinyl butyral "BX-1" (Trademark) made by Sekisui Chemical Co., Ltd. | 10 |
| Sublimable yellow dye: "Macrolex Yellow 6G" (Trademark) made by Bayer A.G. (with a gram-absorptivity coefficient of 300,944) | 5 |
| Solvents: | |
| Toluene | 95 |
| Methyl ethyl ketone | 95 |

Preparation of Magenta Ink composition

The following components were placed in a ball mill and dispersed for 24 hours to obtain a magenta ink composition.

| | Parts by Weight |
|---|---|
| Organic binder agent: Polyvinyl butyral "BX-1" (Trademark) made by Sekisui Chemical Co., Ltd. | 10 |
| Sublimable magenta dye: "HM-1041" (Trademark) made by Mitsui Toatsu Dyes Ltd. (with a gram-absorptivity coefficient of 191,195) | 10 |
| Solvents: | |
| Toluene | 95 |
| Methyl ethyl ketone | 95 |

Preparation of Cyan Ink Composition

The following components were placed in a ball mill and dispersed for 24 hours to obtain a cyan ink composition.

| | Parts by Weight |
|---|---|
| Organic binder agent: Polyvinyl butyral "BX-1" (Trademark) made by Sekisui | 10 |

-continued

| | Parts by Weight |
|---|---|
| Chemical Co., Ltd. | |
| Sublimable cyan dye: "HSO-144" (Trademark) made by Mitsui Toatsu Dyes Ltd. (with a gram-absorptivity coefficient of 189,374) | 10 |
| Solvents: | |
| Toluene | 95 |
| Methyl ethyl ketone | 95 |

On a front surface of a polyethylene telephthalate film with a thickness of 6 μm, serving as a support, provided on a back side thereof with a heat-resistant releasing layer comprising a silicone resin with a thickness of 1 μm, the above-obtained yellow, magenta and cyan ink compositions were coated side by side by a wire bar, and ten dried, thereby forming yellow, magenta and cyan ink layers on the substrate, each ink layer having a thickness of 1 μm.

Thus, a sublimation-type thermal image transfer recording medium according to the present invention was prepared.

Preparation of Image-receiving Medium (A)

A coating liquid A for forming an intermediate layer was prepared by thoroughly mixing and dispersing the following components.

| | Parts by Weight |
|---|---|
| Polyester resin "Vylon 200" (Trademark) made by Toyobo Co., Ltd. | 100 |
| Isocyanate "Burnock DN-950" (Trademark) made by Dainippon Ink & Chemicals, Incorporated | 10 |
| Toluene | 300 |
| Methyl ethyl ketone | 300 |

A coating liquid B for forming a dye-receiving layer was prepared by thoroughly mixing and dispersing the following components.

| (Coating Liquid B) | Parts by Weight |
|---|---|
| Vinyl chloride/vinyl acetate copolymer resin "VYHH" (Trademark) made by Union Carbide Japan K.K. | 100 |
| Amino-modified silicone "SF8417" (Trademark) made by Toray Silicone Co., Ltd. | 1 |
| Toluene | 280 |
| Methyl ethyl ketone | 280 |

The above-prepared coating liquid A and the coating liquid B were successively coated onto a commercially available polyethylene telephthalate film "Lumirror T60"(Trademark), made by Toray Industries, Inc., with a thickness of approximately 100 μm by a wire bar, and then dried at 90° C. for one minute, so that an intermediate layer with a thickness of approximately 3 μm and a dye-receiving with a thickness of approximately 3 μm were overlaid on the polyethylene telephthalate film. Thus, a transparent image-receiving medium (A) for use in the thermal image transfer recording was obtained.

To conduct a thermal image transfer recording test, the above-prepared thermal image transfer recording medium was placed, with the ink layer thereof being directed to the dye-receiving layer of the image-receiving medium (A).

Then, images were thermally transferred to the image-receiving medium (A) with application of thermal energy to the support side of the thermal image transfer recording medium by a thermal head under the following test conditions:

| | |
|---|---|
| Applied electric power: | 432 mW/dot |
| Resolution of the thermal head: | 6 dots/mm |
| Recording time: | 7.0 ms. |
| Applied thermal energy: | 3.02 mJ/dot |

FIG. 1 is a graph showing the relationship between the optical density of the printed image and the thermal energy applied to the thermal image transfer recording medium The optical density of the printed image of transmission-type was measured by a commercially available transmission-type Mcbeth densitometer "TD-504" (Trademark).

A preservability test was carried out by allowing the thermal image transfer recording media to stand at 60° C. and 50%RH for 100 hours under the application of a load of 3 kg/A4 size, with the heat-resistant releasing layer of one thermal image transfer recording medium overlaid on the ink layer of the other one.

The result was that the dye particles did not separate from the surface of the ink layer.

Examples I-2 and I-3 and Comparative Examples I-1 and I-2

The procedure for preparation of the thermal image transfer recording medium in Example I-1 was repeated except that the kind and the amount of each of the yellow, magenta and cyan sublimable-dyes used in Example I-1 were respectively changed as shown in Table 1. Thus, thermal image transfer recording media were separately obtained Using each thermal image transfer recording medium, the thermal image transfer recording test was conducted under the same conditions as in Example I-1.

Figure 2:
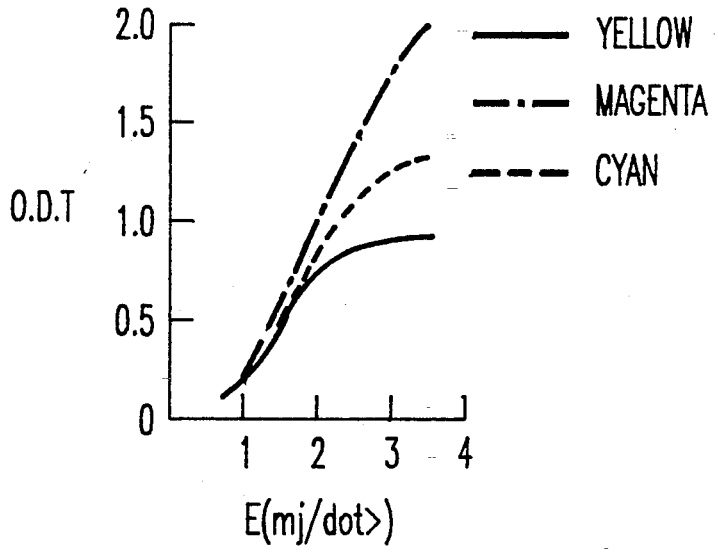
Figure 3:
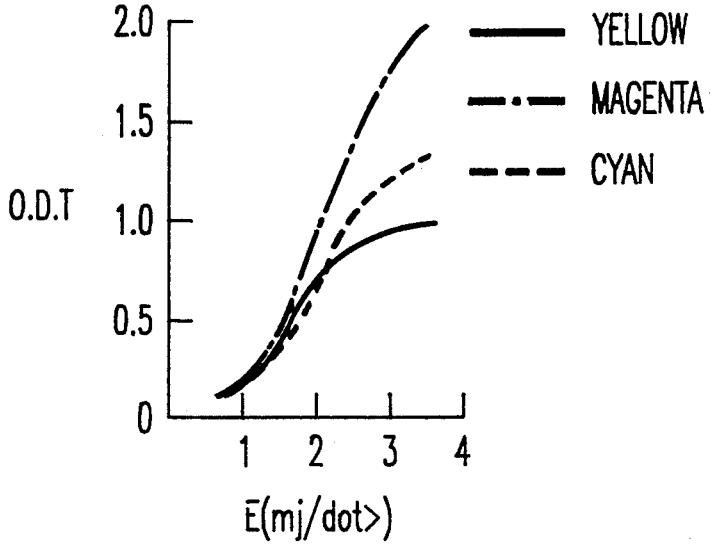
Figure 4:
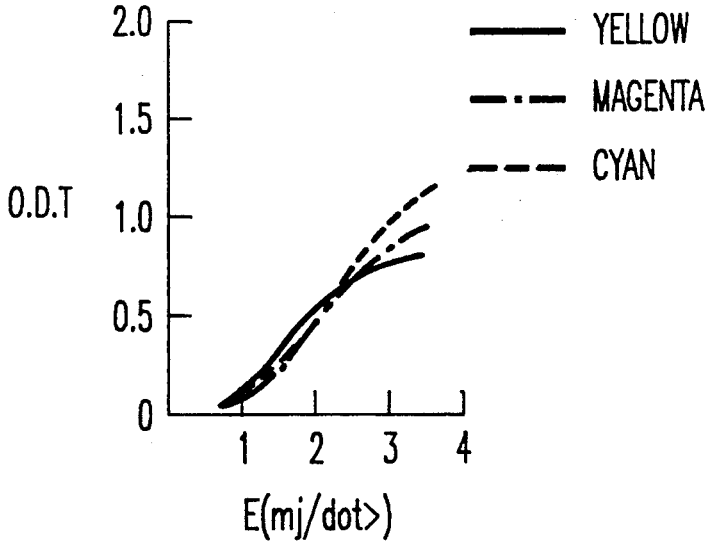
FIG. 4 is a graph showing the relationship between the printed image density and the thermal energy applied to a comparative thermal image transfer recording medium, which is obtained in Comparative Example I-1.

FIGS. 2 to 4 are graphs showing the relationship between the optical density of the printed image and the thermal energy applied to the thermal image transfer recording media respectively obtained in Examples I-2, I-3 and Comparative Example I-1.

The results of the thermal image transfer recording test using the recording medium obtained in Comparative Example I-2, the optical density of the printed image increased as a whole because the dye concentration was increased in the ink layer as compared with the recording medium of Comparative Example I-1 However, the optical density was not sufficient for use in practice.

Then, the same preservability test as in Example I-1 was carried out.

As for the thermal image transfer recording media obtained in Examples I-2, I-3 and Comparative Example I-1, the dye particles did not bleed from the surface of the ink layer did not occur In the case of the thermal image transfer recording medium obtained in Comparative Example I-2, however, a small amount of the dye particles separated from the surface of the ink layer.

TABLE 1

| Example No. | Trademark of Sublimable-dye (Manufacturer) | Gram-absorptivity Coefficient | Parts by Weight | Color (*) |
|---|---|---|---|---|
| I-2 | Yellow VP (Mitsui Toatsu Dyes Ltd.) | 191,300 | 5 | Y |
| | HM-1041 (Mitsui Toatsu Dyes Ltd.) | 191,195 | 8 | M |
| | Macrolex Red Violet R (Bayer A.G.) | 89,366 | 4 | M |
| | Foron Brilliant Blue SR (Sandoz K.K.) | 180,825 | 6 | C |
| | Ceres Blue GN (Bayer A.G.) | 109,070 | 4 | C |
| I-3 | Yellow RP (Mitsui Toatsu Dyes Ltd.) | 201,739 | 5 | Y |
| | HM-1041 (Mitsui Toatsu Dyes Ltd.) | 191,195 | 8 | M |
| | MS Magenta VP Violet (Mitsui Toatsu Dyes Ltd.) | 85,108 | 4 | M |
| | HSO-144 (Mitsui Toatsu Dyes Ltd.) | 189,374 | 9 | C |
| | HM-1238 (Mitsui Toatsu Dyes Ltd.) | 94,520 | 1 | C |
| Comp. Example I-1 | MS Yellow V (Mitsui Toatsu Dyes Ltd.) | 129,105 | 5 | Y |
| | MS Red G (Mitsui Toatsu Dyes Ltd.) | 80,768 | 8 | M |
| | Macrolex Red Violet R (Bayer A.G.) | 89,366 | 4 | M |
| | Ceres Blue GN (Bayer A.G.) | 109,070 | 10 | C |
| Comp. Example I-2 | MS Yellow V (Mitsui Toatsu Dyes Ltd.) | 129,105 | 7 | Y |
| | MS Red G (Mitsui Toatsu Dyes Ltd.) | 80,768 | 10 | M |
| | Macrolex Red Violet R (Bayer A.G.) | 89,366 | 5 | M |
| | Ceres Blue GN Bayer A.G.) | 109,070 | 14 | C |

Color (*)
Y: Yellow
M: Magenta
C: Cyan

COMPARATIVE EXAMPLE I-3

The procedure for preparation of the thermal image transfer recording medium in comparative Example I-1 was repeated except that the thickness of the ink layer was changed from 1 μm to 1.5 μm. Thus, a comparative thermal image transfer recording medium was obtained Using the above thermal image transfer recording medium, the thermal image transfer recording test was conducted by the same manner as in Example I-1.

The optical density of the transmission-type image obtained by the above thermal image transfer recording medium was lower as compared with the case of the recording medium obtained in Comparative Example I-1, when the applied thermal energy was small because the increase in thickness of the ink layer caused decrease in thermosensitivity. When the applied thermal energy was large, the optical density obtained by this recording medium became higher than that obtained by the recording medium of Comparative Example I-1. This is because the deposited amount of the dye was increased.

Then, the same preservability test as in Example I-1 was carried out.

The result was that the dye particles did not separate from the surface of the ink layer.

COMPARATIVE EXAMPLE I-4

The procedure for preparation of the thermal image transfer recording medium in Comparative Example I-1 was repeated except that 3 parts by weight of a commercially available silicone wax "DCQ5-0158A" (Trademark), made by Toray Silicone Co., Ltd., as a low-softening point material was added to each ink composition.

Thus, a comparative thermal image transfer recording medium was obtained.

Using the above thermal image transfer recording medium, the thermal image transfer recording test was conducted by the same manner as in Example I-1.

As a result, the optical density of the transmission-type image obtained by the above thermal image transfer recording medium was similar to that obtained by the recording medium of Example I-2.

Then, the same preservability test as in Example I-1 was carried out.

The result was that the dye particles separated from the surface of the ink layer. The separated dye particles adhered to the heat-resistant releasing layer of the upper recording medium, and consequently, the thermal head was stained with the dye particles when the above heat-resistant releasing layer was brought into contact with the thermal head.

EXAMPLE II-1

Formation of Adhesive layer

The following components were placed in a ball mill and dispersed for 24 hours to obtain a coating liquid for an adhesive layer.

| | Parts by Weight |
|---|---|
| Polyvinyl butyral "BX-1" (Trademark) made by Sekisui Chemical Co., Ltd. | 10 |
| Diisocyanate "Coronate L" (Trademark) made by Nippon Polyurethane Industry Co., Ltd. | 5 |
| Toluene | 95 |
| Methyl ethyl ketone | 95 |

A heat-resistant releasing layer comprising a silicone resin with a thickness of 1 μm was provided on one surface of an aromatic polyamide film with a thickness of 6 μm, which serves as a support. The above-obtained coating liquid for the adhesive layer was coated onto the reverse surface (opposite to the heat-resistant releasing layer) by a wire bar, and then dried, thereby forming an adhesive layer having a thickness of 1 μm.

Preparation of Yellow Ink Composition

The following components were placed in a ball mill and dispersed for 24 hours to obtain a yellow ink composition.

| | Parts by Weight |
|---|---|
| Organic binder agent: Polyvinyl butyral "BX-1" | 7 |

-continued

| | Parts by Weight |
|---|---|
| (Trademark) made by Sekisui Chemical Co., Ltd. | |
| Sublimable yellow dye: "Foron Brilliant Yellow S-6GL" (Trademark) made by Sandoz K.K. (with a gram-absorptivity coefficient of 218,849) | 16 |
| Amino-modified silicone oil "SF8417" (Trademark) made by Toray Silicone Co., Ltd. | 2 |
| Epoxy-modified silicone oil "SF8411" (Trademark) made by Toray Silicone Co., Ltd. | 2 |
| Diisocyanate "Coronate L" (Trademark) made by Nippon Polyurethane Industry Co., Ltd. | 2 |
| Solvents: | |
| Toluene | 70 |
| Methyl ethyl ketone | 70 |

Preparation of Magenta Ink composition

The following components were placed in a ball mill and dispersed for 24 hours to obtain a magenta ink composition.

| | Parts by Weight |
|---|---|
| Organic binder agent: Polyvinyl butyral "BX-1" (Trademark) made by Sekisui Chemical Co., Ltd. | 7 |
| Sublimable magenta dye: "HM-1041" (Trademark) made by Mitsui Toatsu Dye Ltd. (with a gram-absorptivity coefficient of 191,195) | 12 |
| Sublimable magenta dye: "Macrolex Red Violet R" (Trademark) made by Bayer A.G. (with a gram-absorptivity coefficient of 89,366) | 4 |
| Amino-modified silicone oil "SF8417" (Trademark) made by Toray Silicone Co., Ltd. | 2 |
| Epoxy-modified silicone oil "SF8411" (Trademark) made by Toray Silicone Co., Ltd. | 2 |
| Diisocyanate "Coronate L" (Trademark) made by Nippon Polyurethane Industry Co., Ltd. | 2 |
| Solvents: | |
| Toluene | 70 |
| Methyl ethyl ketone | 70 |

Preparation of Cyan Ink composition

The following components were laced in a ball mill and dispersed for 24 hours to obtain a can ink composition.

| | Parts by Weight |
|---|---|
| Organic binder agent: Polyvinyl butyral "BX-1" (Trademark) made by Sekisui Chemical Co., Ltd. | 7 |
| Sublimable cyan dye: "HSO-144" (Trademark) made by Mitsui Toatsu Dyes Ltd. (with a gram-absorptivity coefficient of 189,374) | 16 |
| Amino-modified silicone oil "SF8417" (Trademark) made by Toray Silicone Co., Ltd. | 2 |

-continued

| | Parts by Weight |
|---|---|
| Epoxy-modified silicone oil 'SF8411' (Trademark) made by Toray Silicone Co., Ltd. | 2 |
| Diisocyanate "Coronate L" (Trademark) made by Nippon Polyurethane Industry Co., Ltd. | 2 |
| Solvents: | |
| Toluene | 70 |
| Methyl ethyl ketone | 70 |

The above-obtained yellow, magenta and cyan ink compositions were abreast coated onto the adhesive layer in serial order by a wire bar, and then dried, thereby forming ink layers in the colors of yellow, magenta and cyan side by side in a row, each layer having a thickness of 4.5 μm. Thus, a sublimation-type thermal image transfer recording medium according to the present invention was obtained.

Preparation of Image-receiving Medium (B)

A coating liquid C for forming a dye-receiving layer was prepared by thoroughly mixing and dispersing the following components.

| | Parts by Weight |
|---|---|
| Vinyl chloride/vinyl acetate/vinyl alcohol copolymer "VAGH" (Trademark) made by Union Carbide Japan K.K. | 10 |
| Isocyanate "Coronate L" (Trademark) made by Nippon Polyurethane Industry Co., Ltd. | 5 |
| Amino-modified silicone "SF8417" (Trademark) made by Toray Silicone Co., Ltd. | 0.5 |
| Epoxy-modified silicone "SF8411" (Trademark) made by Toray Silicone Co., Ltd. | 0.5 |
| Toluene | 40 |
| Methyl ethyl ketone | 40 |

The above-prepared coating liquid C for the dye-receiving layer was coated onto a sheet of commercially available synthetic paper "Yupo FPG-150" (Trademark), made by Oji-Yuka Synthetic Paper Co., Ltd., with a thickness of approximately 150 μm, serving as a support, by a wire bar, and then dried at 75° C. for one minute, thereby forming a dye-receiving layer with a thickness of approximately 5 μm. Then, the dye-receiving layer formed on the synthetic paper was allowed to stand at 80° C. for 3 hours to cure the composition of the dye-receiving layer. Thus, image-receiving medium (B) for use in the thermal image transfer recording was obtained.

To conduct a thermal image transfer recording test, the above-prepared thermal image transfer recording medium was placed, with the ink layer thereof being directed to the dye-receiving layer of the image-receiving medium (B).

Then, images were thermally transferred to the image-receiving medium (B) by applying the thermal energy to the support side of the thermal image transfer recording medium by a thermal head, with the applied electric power being 158 mW/dot, and the applied thermal energy, 0.76 mJ/dot.

Figure 5:
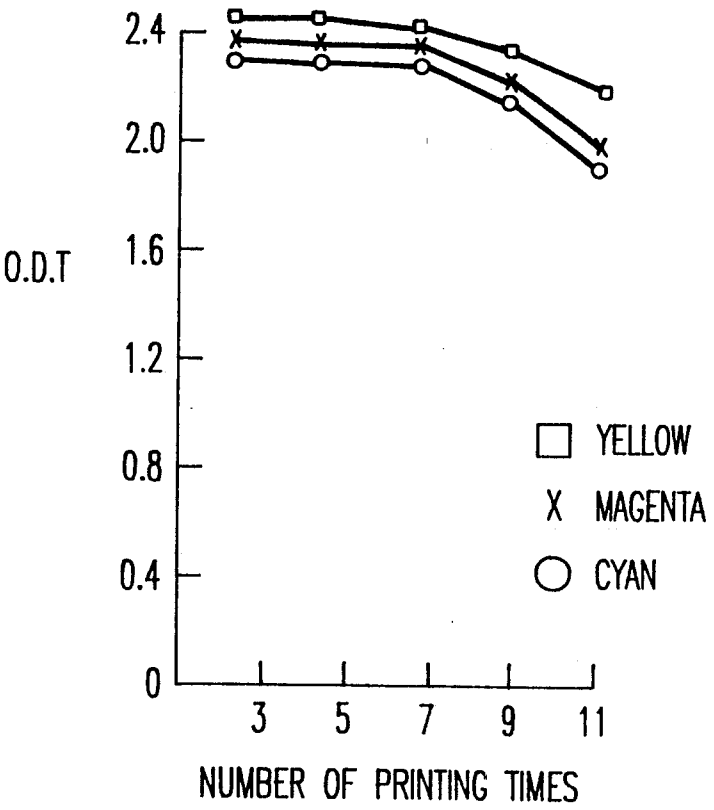

FIG. 5 is a graph showing the relationship between the number of printing times and the optical density of the printed image obtained by the thermal image transfer recording medium of Example II-1.

The density of the printed image of reflection-type was measured by a commercially available reflection-type Mcbeth densitometer "RD-918" (Trademark).

As can be seen from the graph, a decrease in image density with increasing the number of printing times is moderate.

Examples II-2 and II-3 and Comparative Example II-1

The procedure for preparation of the thermal image transfer recording medium in Example II-1 was repeated except that the kind and the amount of the yellow, magenta and cyan sublimable-dyes used in Example II-1 were respectively changed as shown in Table 2. Thus, thermal image transfer recording media were separately obtained.

Using each thermal image transfer recording medium, the thermal image transfer recording test was conducted by the same manner as in Example II-1.

Figure 6:
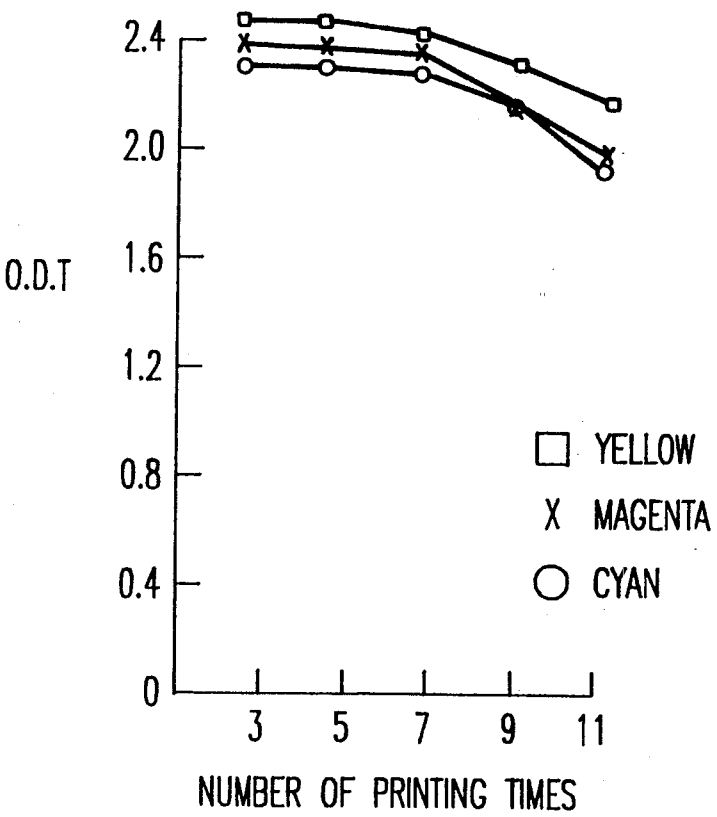
FIGS. 5 to 7 are graphs showing the relationship between the number of printing times and the printed image density obtained by thermal image transfer recording media according to the present invention, which are respectively prepared in Examples II-1 to II-3.
Figure 7:
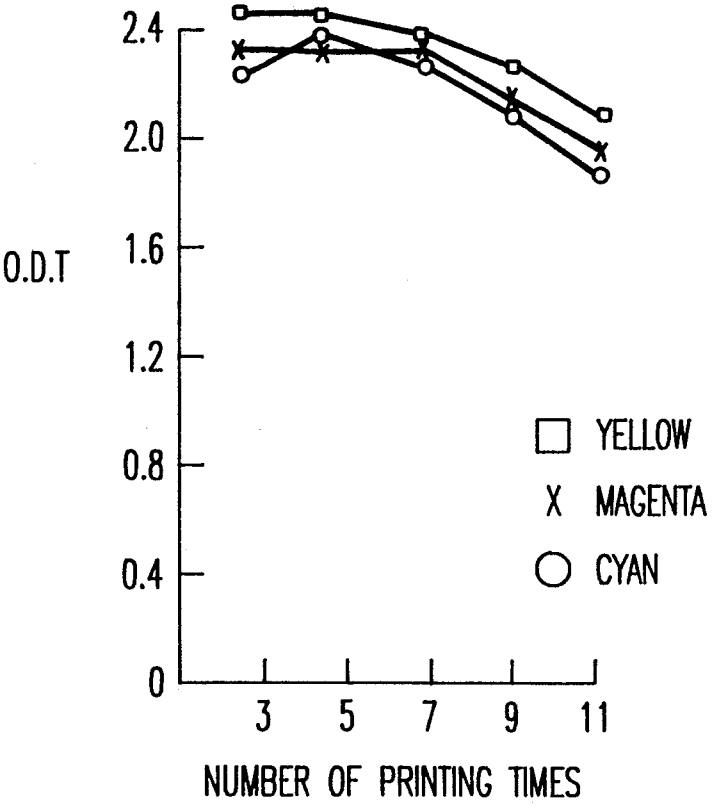

FIGS. 6 and 7 are graphs showing the relationship between the number of printing times and the optical density of the printed image obtained by the thermal image transfer recording media of Examples II-2 and II-3.

Figure 8:
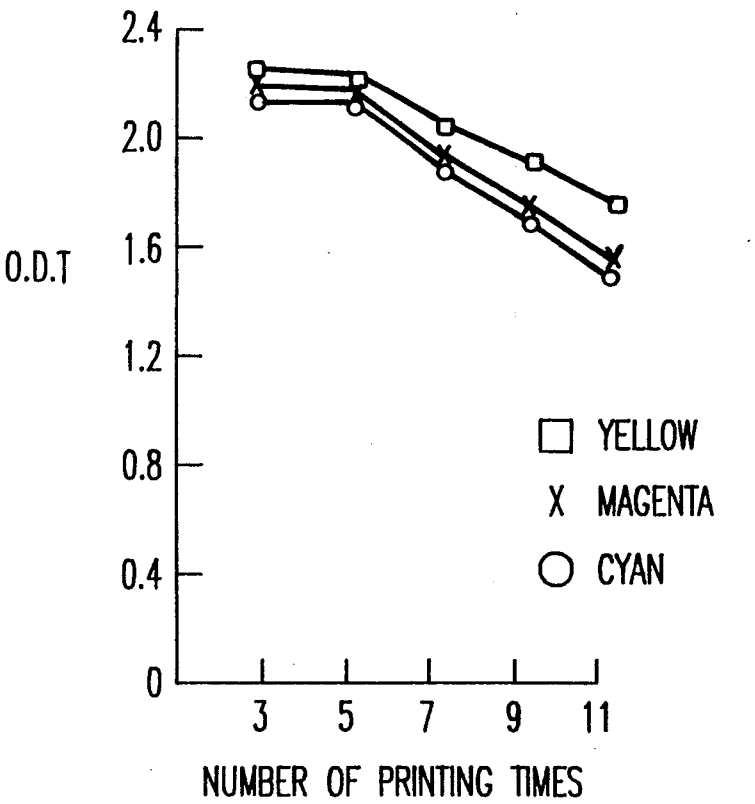
FIGS. 8 and 12 are graphs showing the relationship between the number of printing times and the printed image density obtained by comparative thermal image transfer recording media, which are respectively prepared in Comparative Examples II-1 and II-2.

FIG. 8 is a graph showing the relationship between the number of printing times and the optical density of the printed image obtained by the thermal image transfer recording medium of Comparative Example II-1.

TABLE 2

| Example No. | Trademark of Sublimable-dye (Manufacturer) | Gram-absorptivity Coefficient | Parts by Weight | Color (*) |
|---|---|---|---|---|
| II-2 | Yellow VP (Mitsui Toatsu Dyes Ltd.) | 191,300 | 16 | Y |
| | HM-1041 (Mitsui Toatsu Dyes Ltd.) | 191,195 | 12 | M |
| | MS Magenta VP Violet (Mitsui Toatsu Dyes Ltd.) | 85,108 | 4 | M |
| | Foron Brilliant Blue SR (Sandoz K.K.) | 180,825 | 16 | C |
| II-3 | Yellow RP (Mitsui Toatsu Dyes Ltd.) | 201,739 | 16 | Y |
| | HM-1041 (Mitsui Toatsu Dyes Ltd.) | 191,195 | 8 | M |
| | Sudan Red 380 (BASF Japan Ltd.) | 160,136 | 4 | M |
| | Macrolex Red Violet R (Bayer A.G.) | 89,366 | 4 | M |
| | Foron Brilliant Blue SR (Sandoz K.K.) | 180,825 | 12 | C |
| | Ceres Blue GN (Bayer A.G.) | 109,070 | 4 | C |
| Comp. Example II-1 | Sudan Yellow 150 (BASF Japan Ltd.) | 135,318 | 16 | Y |
| | MS Red G (Mitsui Toatsu Dyes Ltd.) | 80,768 | 12 | M |
| | Macrolex Red Violet R (Bayer A.G.) | 89,366 | 4 | M |
| | Ceres Blue GN Bayer A.G.) | 109,070 | 16 | C |

Color (*)
Y: Yellow
M: Magenta
C: Cyan

EXAMPLE II-4

Formation of Adhesive layer

The following components were placed in a ball mill and dispersed for 24 porous to obtain a coating liquid for an adhesive layer.

| | Parts by Weight |
|---|---|
| Polyvinyl butyral "BX-1" (Trademark) made by Sekisui Chemical Co., Ltd. | 10 |
| Diisocyanate "Coronate L" (Trademark) made by Nippon Polyurethane Industry Co., Ltd. | 5 |
| Solvents: | |
| Toluene | 95 |
| Methyl ethyl ketone | 95 |

A heat-resistant releasing layer comprising a silicone resin with a thickness of 1 μm was provided on one surface of an aromatic polyamide film with a thickness of 6 μm, which serves as a support. The above-obtained coating liquid for the adhesive layer was coated onto the reverse surface (opposite to the heat-resistant releasing layer) by a wire bar, and then dried, thereby forming an adhesive layer having a thickness of 1 μm.

Formation of Dye-supply Layer (Yellow)

The following components were placed in a ball mill and dispersed for 24 hours to obtain a yellow ink composition.

| | Parts by Weight |
|---|---|
| Organic binder agent: Polyvinyl butyral "BX-1" (Trademark) made by Sekisui Chemical Co., Ltd. | 7 |
| Sublimable yellow dye: "Foron Brilliant Yellow S-6GL" (Trademark) made by Sandoz K.K. (with a gram-absorptivity coefficient of 218,849) | 30 |
| Polyethylene oxide | 3 |
| Diisocyanate "Coronate L" (Trademark) made by Nippon Polyurethane Industry Co., Ltd. | 2 |
| Solvents: | |
| Toluene | 95 |
| Methyl ethyl ketone | 95 |

The above-obtained yellow ink composition as coated onto the adhesive layer by a wire bar, and then dried, thereby forming a yellow dye-supply layer having a thickness of 4.5 μm.

formation of Dye-transfer Layer (Yellow)

The following components were placed in a ball mill and dispersed for 24 hours to obtain a yellow ink composition.

| | Parts by Weight |
|---|---|
| Organic binder agent: Polyvinyl butyral "BX-1" (Trademark) made by Sekisui Chemical Co., Ltd. | 10 |
| Sublimable yellow dye: "Foron Brilliant Yellow S-6GL" (Trademark) made by Sandoz K.K. (with a gram-absorptivity coefficient of 218,849) | 4 |

-continued

| | Parts by Weight |
|---|---|
| Amino-modified silicone oil "SF8417" (Trademark) made by Toray Silicone Co., Ltd. | 1.5 |
| Epoxy-modified silicone oil "SF8411" (Trademark) made by Toray Silicone Co., Ltd. | 1.5 |
| Diisocyanate "Coronate L" (Trademark) made by Nippon Polyurethane Industry Co., Ltd. | 2 |
| Solvents: | |
| Toluene | 95 |
| Methyl ethyl ketone | 95 |

The above-obtained yellow ink composition was coated onto the above yellow dye-supply layer by a wire bar, and then dried, thereby forming a yellow dye-transfer layer having a thickness of 1.0 μm. Thus, a sublimation-type thermal image transfer recording sheet for yellow color was obtained.

Formation of Dye-supply Layer (Magenta)

The following components were placed in a ball mill and dispersed for 24 hours to obtain a magenta ink composition.

| | Parts by Weight |
|---|---|
| Organic binder agent: Polyvinyl butyral "BX-1" (Trademark) made by Sekisui Chemical Co., Ltd. | 7 |
| Sublimable magenta dye: "HM-1041" (Trademark) made by Mitsui Toatsu Dyes Ltd. (with a gram-absorptivity coefficient of 191,195) | 20 |
| Sublimable magenta dye: "Macrolex Red Violet R" (Trademark) made by Bayer A.G. (with a gram-absorptivity coefficient of 89,366) | 10 |
| Polyethylene oxide | 3 |
| Diisocyanate "Coronate L" (Trademark) made by Nippon Polyurethane Industry Co., Ltd. | 2 |
| Solvents: | |
| Toluene | 95 |
| Methyl ethyl ketone | 95 |

The above-obtained magenta ink composition was coated onto the adhesive layer, prepared y the same method as in the above, by a wire bar, and then dried, thereby forming a magenta dye-supply layer having a thickness of 4.5 μm.

Formation of Dye-transfer Layer (Magenta)

The following components were placed in a ball mill and dispersed for 24 hours to obtain a magenta ink composition.

| | Parts by Weight |
|---|---|
| Organic binder agent: Polyvinyl butyral "BX-1" (Trademark) made by Sekisui Chemical Co., Ltd. | 10 |
| Sublimable magenta dye: "HM-1041" (Trademark) made by Mitsui Toatsu Dyes Ltd. (with a gram-absorptivity coefficient of 191,195) | 7 |
| Sublimable magenta dye: "Macrolex Red Violet R" (Trademark) made by Bayer A.G. (with a gram-absorptivity coefficient of 89,366) | 3 |
| Amino-modified silicone oil "SF8417"(Trademark) made by Toray Silicone Co., Ltd. | 1.5 |
| Epoxy-modified silicone oil "SF8411" (Trademark) made by Toray Silicone Co., Ltd. | 1.5 |
| Diisocyanate "Coronate L" (Trademark) made by Nippon Polyurethane Industry Co., Ltd. | 2 |
| Solvents: | |
| Toluene | 95 |
| Methyl ethyl ketone | 95 |

The above-obtained magenta ink composition was coated onto the above magenta dye-supply layer by a wire bar, and then dried, thereby forming a magenta dye-transfer layer having a thickness of 1.0 μm. Thus, a sublimation-type thermal image transfer recording sheet for magenta color was obtained.

Formation of Dye-supply Layer (Cyan)

The following components were place din a ball mill and dispersed for 24 hours to obtain a cyan ink composition.

| | Parts by Weight |
|---|---|
| Organic binder agent: Polyvinyl butyral "BX-1" (Trademark) made by Sekisui Chemical Co., Ltd. | 7 |
| Sublimable cyan dye: "HSO-144" (Trademark) made by Mitsui Toatsu Dyes Ltd. (with a gram-absorptivity cooefficient of 189,374) | 30 |
| Polyethylene oxide | 3 |
| Diisocyanate "Coronate L" (Trademark) made by Nippon Polyurethane Industry Co., Ltd. | 2 |
| Solvents: | |
| Toluene | 95 |
| Methyl ethyl ketone | 95 |

The above-obtained cyan ink composition as coated onto the adhesive layer, prepared by the same method as in the above, by a wire bar, and then dried, thereby forming a cyan dye-supply layer having a thickness of 4.5 μm.

Formation of Dye-transfer Layer (Cyan)

The following components were placed in a ball mill and dispersed for 24 hours to obtain a cyan ink composition.

| | Parts by Weight |
|---|---|
| Organic binder agent: Polyvinyl butyral "BX-1" (Trademark) made by Sekisui Chemical Co., Ltd. | 10 |
| Sublimable cyan dye: "HSO-144" (Trademark) made by Mitsui Toatsu Dyes Ltd. (with a gram-absorptivity coefficient of 189,374) | 8 |
| Amino-modified silicone oil "SF8417" (Trademark) made | 1.5 |

-continued

| | Parts by Weight |
|---|---|
| by Toray Silicone Co., Ltd. | |
| Epoxy-modified silicone oil "SF8411" (Trademark) made by Toray Silicone Co., Ltd. | 1.5 |
| Diisocyanate "Coronate L" (Trademark) made by Nippon Polyurethane Industry Co., Ltd. | 2 |
| Solvents: | |
| Toluene | 95 |
| Methyl ethyl ketone | 95 |

The above-obtained cyan ink composition was coated onto the above cyan dye-supply layer by a wire bar, and then dried, thereby forming a cyan dye-transfer layer having a thickness of 1.0 μm. Thus, a sublimation-type thermal image transfer recording sheet for cyan color was obtained.

The above-prepared thermal image transfer recording sheets were arranged side by side in a row in the order of yellow, magenta and cyan, with each dye-transfer layer of the recording sheet being directed to the dye-receiving layer of the image-receiving medium (B).

Then, a thermal image transfer recording test was conducted by the same method as in Example II-1.

Figure 9:
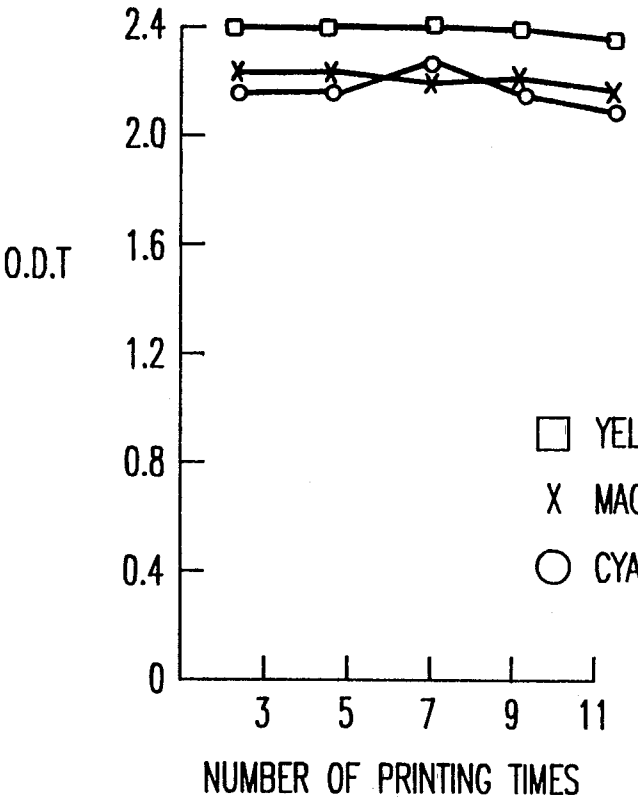
FIGS. 9 to 11 are graphs showing the relationship between the number of printing times and the printed image density obtained by thermal image transfer recording media according to the present invention, which are respectively prepared in Examples II-4 to II-6.

FIG. 9 is a graph showing the relationship between the number of printing times and the optical density of the printed image obtained by the thermal image transfer recording medium of Example II-4.

The density of the printed image of reflection-type was measured by a commercially available reflection-type Mcbeth densitometer "RD-918" (Trademark).

As can be seen from the graph, a decrease in image density with increasing the number of printing times is moderate.

Examples II-5 and II-6 and Comparative Example II-2

The procedure for preparation of the thermal image transfer recording medium in Example II-4 was repeated except that the kind and the amount of the yellow, magenta and cyan sublimable-dyes used in Example II-1 were respectively changed as shown in Table 3. Thus, thermal image transfer recording media were separately obtained.

Using each thermal image transfer recording medium, the thermal image transfer recording test was conducted by the same manner as in Example II-4.

Figure 10:
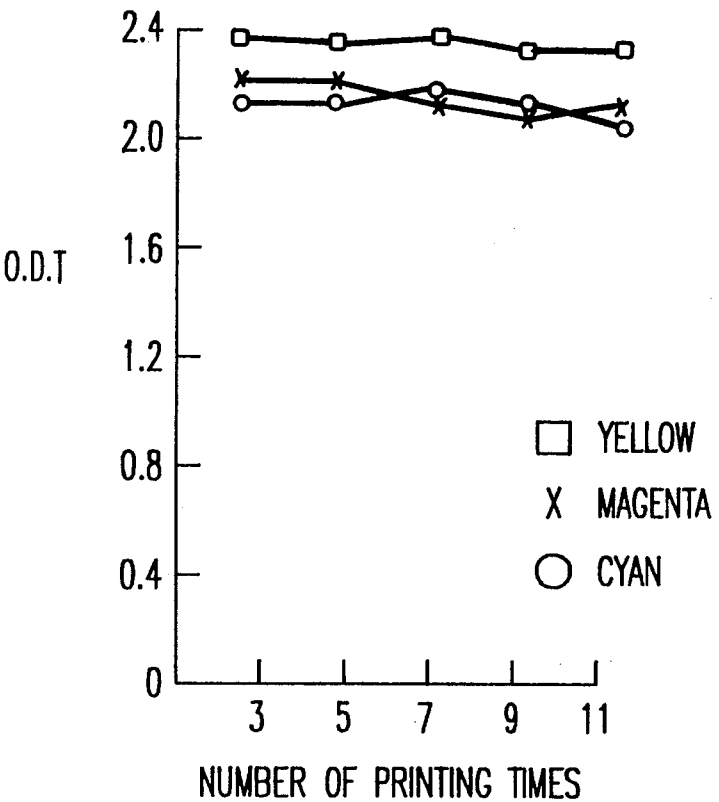
Figure 11:
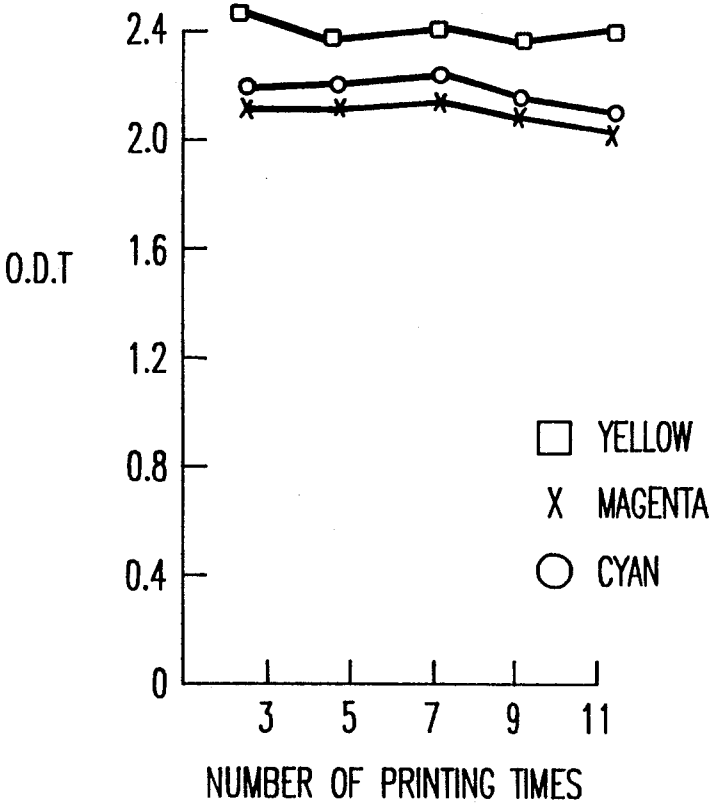

FIGS. 10 and 11 are graphs showing the relationship between the number of printing times and the optical density of the printed image obtained by the thermal image transfer recording media of Examples II-5 and II-6.

Figure 12:
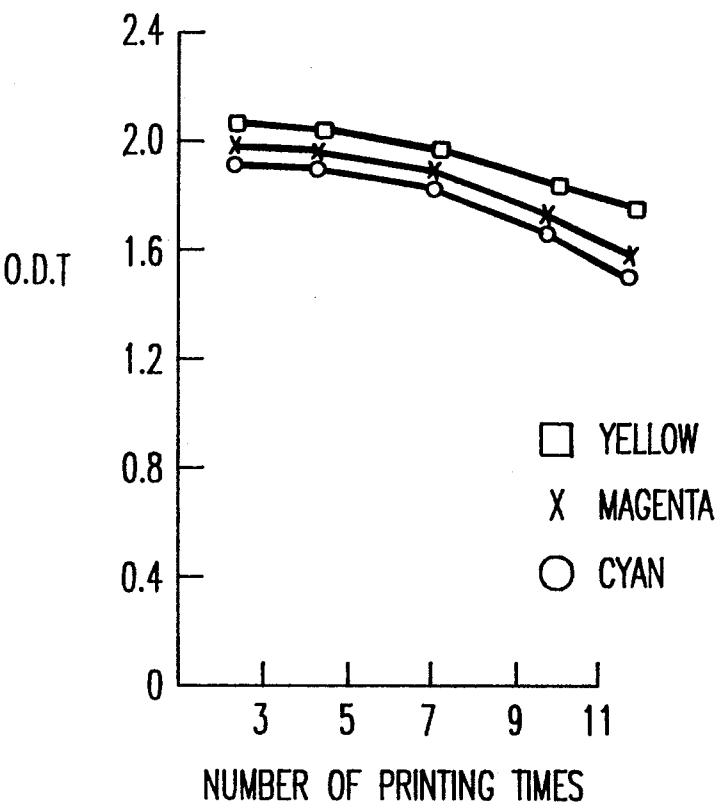

FIG. 12 is a graph showing the relationship between the number of printing times and the optical density of the printed image obtained by the thermal image transfer recording medium of Comparative Example II-2.

TABLE 3

| Example No. | Trademark of Sublimable-dye (Manufacturer) | Gram-absorptivity Coefficient | Parts by Weight | Color (*) |
|---|---|---|---|---|
| II-5 | Yellow VP (Mitsui Toatsu Dyes Ltd.) | 191,300 | DS = 30 DT = 4 (**) | Y |
| | HM-1041 (Mitsui Toatsu Dyes Ltd.) | 191,195 | DS = 20 DT = 7 | M |
| | MS Magenta VP Violet (Mitsui Toatsu Dyes Ltd.) | 85,108 | DS = 10 DT = 3 | M |
| | Foron Brilliant Blue SR (Sandoz K.K.) | 180,825 | DS = 30 DT = 8 | C |
| II-6 | Yellow RP (Mitsui Toatsu Dyes Ltd.) | 201,739 | DS = 30 DT = 4 | Y |
| | M-1041 (Mitsui Toatsu Dyes Ltd.) | 191,195 | DS = 20 DT = 6 | M |
| | Sudan Red 380 (BASF Japan Ltd.) | 160,136 | DS = 5 DT = 2 | M |
| | Macrolex Red Violet R (Bayer A.G.) | 89,366 | DS = 5 DT = 2 | M |
| | Foron Brilliant Blue SR (Sandoz K.K.) | 180,825 | DS = 20 DT = 6 | C |
| | Ceres Blue GN (Bayer A.G.) | 109,070 | DS = 10 DT = 4 | C |
| Comp. Example II-2 | Sudan Yellow 150 (BASF Japan Ltd.) | 135,318 | DS = 30 DT = 4 | Y |
| | MS Red G (Mitsui Toatsu Dyes Ltd.) | 80,768 | DS = 20 DT = 6 | M |
| | Macrolex Red Violet R (Bayer A.G.) | 89,366 | DS = 10 DT = 4 | M |
| | Ceres Blue GN (Bayer A.G.) | 109,070 | DS = 30 DT = 10 | C |

(*) Color
Y: Yellow
M: Magenta
C: Cyan
(**) Parts by weight
DS: the amount incorporated into dye-supply layer
DT: the amount incorporated into dye-transfer layer As previously described, the thermal image transfer recording medium of e present invention has eh following advantages because the yellow, magenta and cyan dyes contained in the respective ink layers have a gram-absorptivity coefficient of 150,000 or more:

(1) the ink layer of the thermal image transfer recording medium can be prevented from transferring to an image-recording medium when the thermal energy is applied to the recording medium;
(2) the preservability of the ink layer is good;
(3) the sensitivity of the ink layer to heat is high;
(4) the optical density of the printed transmission-type image, for example an image formed on an OHP film, is sufficiently high;
(5) a well-balanced multicolor image can be obtained;
(6) images with high density can be repeatedly obtained when the multiple printing method is employed; and
(7) yellow, magenta and cyan sublimable dyes contained in the respective ink layers can be economically used when the multiple printing method is employed

What is claimed is:

1. A sublimation thermal image transfer recording medium comprising (i) a support and (ii) a plurality of ink layers with different colors formed on said support, each ink layer comprising an organic binder agent and a sublimable dye dispersed in said organic binder agent, with the gram-absorptivity coefficient of said sublimable dye being 150,000 or more.

2. The sublimation thermal image transfer recording medium as claimed in claim 1, wherein said ink layers are composed of a yellow ink layer, a magenta ink layer, and a cyan ink layer.

3. The sublimation thermal image transfer recording medium as claimed in claim 1, wherein said ink layers are composed of a yellow ink layer, a magenta ink layer, a cyan ink layer, and a black ink layer.

4. The sublimation thermal image transfer recording medium as claimed in claim 1, wherein said binder agent contained in said ink layer is selected from the group consisting of a vinyl chloride resin, a vinyl acetate resin, polyamide, polyethylene, polycarbonate, polystyrene, polypropylene, an acrylic resin, a phenolic resin, polyester, polyurethane, an epoxy resin, a silicone resin, a fluorine-containing resin, a butyral resin, a melamine resin, a natural rubber, a synthetic rubber, polyvinyl alcohol and a cellulose resin.

5. The sublimation thermal image transfer recording medium as claimed in claim 1, wherein the concentration of said sublimable dye in said ink layer is in the range of about 5 to 80 wt.%.

6. The sublimation thermal image transfer recording medium as claimed in claim 1, wherein the thickness of said ink layer is 0.1 to 30 μm.

7. The sublimation thermal image transfer recording medium as claimed in claim 1, wherein said binder agent contained in said ink layer is a urethane compound formed by allowing a compound having an active hydrogen to react with an isocyanate compound.

8. The sublimation thermal image transfer recording medium as claimed in claim 7, wherein said compound having an active hydrogen is selected from the group consisting of polyvinyl butyral, polyvinyl acetal, polyurethane polyol, polyether polyol, polyester polyol, polyacrylate, an acryl—polyester copolymer, an alkyd resin, silicone polyester, an epoxy resin having an epoxy group opened by an alkanol amine.

9. The sublimation thermal image transfer recording medium as claimed in claim 7, wherein said isocyanate compound is selected from the group consisting of 2,4-tolylenediisocyanate, 2,6-tolylenediisocyanate, 4,4'-diphenylmethane diisocyanate, hexamethylene diisocyanate, xylylene diisocyanate, triphenylmethane triisocyanate, isophorone diisocyanate, bisisocyanate methylcyclohexane and trimethylhexamethylene diisocyanate.

10. The sublimation thermal image transfer recording medium as claimed in claim 1, wherein said ink layer further comprises a lubricant or releasant.

11. The sublimation thermal image transfer recording medium as claimed in claim 10, wherein said lubricant or releasant is in an amount of 5 to 30 wt.% of the total weight of said ink layer.

12. The sublimation thermal image transfer recording medium as claimed in claim 1, further comprising an adhesive layer between said support and said ink layer.

13. The sublimation thermal image transfer recording medium as claimed in claim 1, further comprising a heat-resistant releasing layer, formed on the reverse surface of said support.

14. The sublimation thermal image transfer recording medium as claimed in claim 1, wherein said ink layer comprises an intermediate layer and a dye-supply layer formed thereon.

* * * * *

UNITED STATES PATENT AND TRADEMARK OFFICE

CERTIFICATE OF CORRECTION

PATENT NO. : 5,286,706

DATED : February 15, 1994

INVENTOR(S) : Hidehiro Mochizuki et al

It is certified that error appears in the above-indentified patent and that said Letters Patent is hereby corrected as shown below:

Column 1, line 13, "performing multiply" should read --performing multiple--.

Column 2, line 40, "wherein" should read --wherein:--.

Column 3, line 36, "thereon A multicolor" should read --thereon. A multicolor--;

line 41, "density It is," should read --density. It is, --;

line 44, "is producing" should read --is produced--.

Column 4, line 20, "layer Particularly" should read --layer. Particularly--;

line 52, "layer More" should read --layer. More--;

line 61, "amine Of these" should read --amine. Of these--.

Column 6, line 40, "Ink composition" should read --Ink Composition--.

UNITED STATES PATENT AND TRADEMARK OFFICE

CERTIFICATE OF CORRECTION

PATENT NO. : 5,286,706

DATED : February 15, 1994

INVENTOR(S) : Hidehiro Mochizuki et al

It is certified that error appears in the above-indentified patent and that said Letters Patent is hereby corrected as shown below:

Column 7, line 19, "and ten dried" should read --and then dried--;

line 31, "following components." should read --following components.

(Coating Liquid A)--;

line 62, "dye-receiving with" should read --dye-receiving layer with--.

Column 8, line 18, "medium The" should read --medium. The--;

line 41, "separately obtained" should read --separately obtained.--;

line 56, "Example I-1 However" should read --Example I-1. However--;

line 65, "ink layer did not occur In" should read --ink layer. In--.

Column 9, line 55, "was obtained" should read --was obtained.--.

UNITED STATES PATENT AND TRADEMARK OFFICE

CERTIFICATE OF CORRECTION

PATENT NO. : 5,286,706

DATED : February 15, 1994

INVENTOR(S) : Hidehiro Mochizuki et al

It is certified that error appears in the above-indentified patent and that said Letters Patent is hereby corrected as shown below:

Column 12, line 28, "following components." should read --following components.

(Coating Liquid C)--.

Column 13, line 64, "Bayer A.G.)" should read --(Bayer A.G.)--.

Column 14, line 5, "24 porous" should read --24 hours--;
line 54, "formation of" should read --Formation of--.

Column 15, line 49, "prepared y the" should read --prepared by the--.

Column 16, line 26, "place din" should read --placed in--.

Column 18, line 12, "M-1041" should read --HM-1041--;
line 35, "of e present" should read --of the present--;

UNITED STATES PATENT AND TRADEMARK OFFICE

CERTIFICATE OF CORRECTION

PATENT NO. : 5,286,706

DATED : February 15, 1994

INVENTOR(S) : Hidehiro Mochizuki et al

It is certified that error appears in the above-indentified patent and that said Letters Patent is hereby corrected as shown below:

Column 18, line 42, "image-recording medium" should read --image-receiving medium--.

Signed and Sealed this

Fourth Day of April, 1995

*Attest:*

*Attesting Officer*

BRUCE LEHMAN

*Commissioner of Patents and Trademarks*